US005205107A

United States Patent [19]

Herink

[11] Patent Number: 5,205,107

[45] Date of Patent: Apr. 27, 1993

[54] BAG LOADING APPARATUS

[75] Inventor: Albert R. Herink, Akron, Ohio

[73] Assignee: Sheridan Lee Combs, Akron, Ohio ; a part interest

[21] Appl. No.: 890,020

[22] Filed: May 27, 1992

[51] Int. Cl.[5] ..... B65B 39/08; B65B 67/12

[52] U.S. Cl. ..... 53/255; 53/390; 141/390

[58] Field of Search ..... 53/390, 255, 384.1, 53/570; 141/10, 114, 316, 390

[56] References Cited

U.S. PATENT DOCUMENTS

| | | | |
|---|---|---|---|
| 133,562 | 12/1872 | Chaffin . | |
| 285,692 | 9/1883 | Sherman . | |
| 744,338 | 11/1903 | Hall . | |
| 1,167,782 | 1/1916 | Richards . | |
| 1,182,412 | 5/1916 | Olesberg . | |
| 1,234,057 | 7/1917 | McIntyre . | |
| 2,656,082 | 10/1953 | Brown | 53/255 X |
| 2,966,770 | 1/1961 | Lewis | 53/255 |
| 3,161,003 | 12/1964 | Grintz | 53/255 |
| 3,255,570 | 6/1966 | Weimer | 53/390 |
| 3,983,914 | 10/1976 | Benson | 141/390 |
| 4,014,157 | 3/1977 | Pearce | 53/390 X |
| 4,183,194 | 1/1980 | Lucke | 53/571 |
| 4,749,011 | 6/1988 | Rylander | 53/390 X |
| 4,760,982 | 8/1988 | Cooke | 141/390 X |
| 4,884,603 | 12/1989 | Simpson | 53/390 X |
| 5,065,965 | 11/1991 | Aulabaugh | 141/390 X |
| 5,095,685 | 3/1992 | Latham | 53/384.1 X |

*Primary Examiner*—Horace M. Culver

*Attorney, Agent, or Firm*—Renner, Kenner, Greive, Bobak, Taylor & Weber

[57] ABSTRACT

Loading apparatus (10, 110) for collecting particulate matter and directing it into a bag (B), including a generally planar base (11, 111) having a pair of spaced lateral edges (14, 15) and a pair of spaced ends (12, 13) joining the edges, a pair of side plates (20, 21; 120, 121) pivotally attached to said spaced lateral edges and movable between a storage position substantially parallel to said base and an operating position substantially perpendicular to said base, and means (60, 60) for temporarily positioning and retaining the bag when said side plates are in said operating position.

12 Claims, 3 Drawing Sheets

BAG LOADING APPARATUS

TECHNICAL FIELD

Generally, the present invention relates to bag loading apparatus. More particularly, the present invention relates to bag loading apparatus to assist in loading particulate matter into bags. More specifically, the present invention relates to bag loading apparatus that mounts a bag or sack by the opening therein, which is readily manipulated to gather and/or scoop particulate matter and which facilitates transfer of the particulate matter into a bag or sack mounted thereon.

BACKGROUND ART

Devices to assist in the loading of particulate matter into bags, sacks, or the like have been known in the art for many years. Common uses for such devices have included the bagging of grain or granuled grains from bulk lots to sacks for processing or transporting selected, relatively small quantities. Such devices have been variously referred to as bag holders, loaders, fillers, and scoops, depending upon the function or combination of functions which the particular device is designed to perform.

Many early loading devices of this general type were concerned only with providing a holding device on which a bag or sack could be mounted in such a manner that the mouth or opening would be maintained in an extended or open position to receive particulate matter. In essence, these devices contemplated a holding device operable by a person to position a bag or sack for receiving particulate matter which is gathered and loaded by another person employing a shovel, scoop, or similar implement. In some instances, these devices were provided with projecting handles to facilitate manual gripping and with some type of hooks or other retainers for temporarily holding or suspending a bag or sack.

Another type of bag loading device was directed toward providing for operation by a single person rather than the two people normally required with the conventional bag holding devices. These devices took the approach of combining a bag holding device with a scoop or shovel which could be manipulated by one person to gather and direct particulate matter into a bag or sack mounted on the device. These devices commonly had a portion of the structure shaped like a scoop or shovel or, in some instances, had an attached scoop or shovel which could be manipulated to gather and retain a quantity of particulate matter and transfer it to a suspended sack or bag. Normally, projecting handles were positioned at two or more locations on the device to facilitate its manipulation for the gathering and bagging functions of particulate matter.

In the instance of either the bag holding devices or the combined scooping and holding devices, various intricate mechanisms were introduced to endeavor to provide for temporary attachment of a bag or sack in a manner which would support relatively heavy particulate matter while providing for the possibility of quick release of a filled bag and the attachment of an empty bag to permit a substantially continuous bagging operation. In this respect, various types of hooks, clamping rings, and other devices have been employed; however, most of these devices which operate effectively have been relatively complex and/or difficult to manipulate while holding a bag in position on the loading device.

Most of the bag loading devices of the types discussed above are necessarily of a sufficient size such that they are somewhat bulky and relatively difficult to store or transport. For the most part, little attention has apparently been given to providing a bag loading device which is operationally effective but is capable of being readily collapsed or dismantled to facilitate storage or transport. Thus, no reliable, effective, collapsible bag loading device has appeared on the market which provides a combination of the desirable features for a bag loading device of this type.

DISCLOSURE OF THE INVENTION

Therefore, an object of the present invention is to provide bag loading apparatus for particulate matter which permits a single operator to collect material and deposit it in a bag or sack. Another object of the present invention is to provide such bag loading apparatus which permits a bag or sack to be quickly and easily temporarily attached thereto or detached therefrom by a single operator. A further object of the present invention is to provide such bag loading apparatus which has clamping elements that reliably maintain a bag or sack in operative position thereon, even with the weight of a loaded sack or bag, while permitting quick, easy release of the bag or sack by virtue of a clamping device which can be readily manually actuated by an operator.

Another object of the present invention is to provide bag loading apparatus for particulate matter which is of a generally elongate, rectangular configuration but which convergingly tapers from a material scooping portion through a transition area to a bag entry portion. A further object of the present invention is to provide such a bag loading apparatus which maintains the relatively movable parts thereof in the normal operating position merely by means of the interrelationship between the parts in the operative position for loading particulate matter. Yet another object of the present invention is to provide a form of bag loading device which employs a pivoting latch for positively interlocking the movable elements in position for operation of the floating apparatus.

A further object of the present invention is to provide bag loading apparatus for particulate matter which has hand openings and gripping elements strategically placed thereon for ease of gathering and directing particulate matter at a scoop portion and for directing the material to the bag loading portion by merely effecting a tipping of the device for gravity-actuated traverse of the particulate matter.

A further object of the present invention is to provide bag loading apparatus for particulate matter which is of a compact size while permitting bags or sacks to be quickly and easily filled. Yet a further object of the present invention is to provide such a bag loading apparatus which is capable of being quickly and easily folded or collapsed to an essentially planar configuration for ease of storage or transportation, as in conjunction with a backpack. Still a further object of the present invention is to provide such bag loading apparatus which may be constructed of relatively inexpensive thin gauge metal or plastic while affording sufficient rigidity and durability to withstand the rigorous operating conditions to which devices of this nature may be subjected.

In general, the present invention contemplates loading apparatus for collecting particulate matter and directing it into a bag, including a generally planar base having a pair of spaced lateral edges and a pair of spaced ends joining the edges, a pair of side plates pivotally attached to the spaced lateral edges and movable between a storage position substantially parallel to the base and an operating position substantially perpendicular to the base, and means for temporarily positioning and retaining the bag when the side plates are in the operating position.

PREFERRED EMBODIMENT FOR CARRYING OUT THE INVENTION

Figure 1:
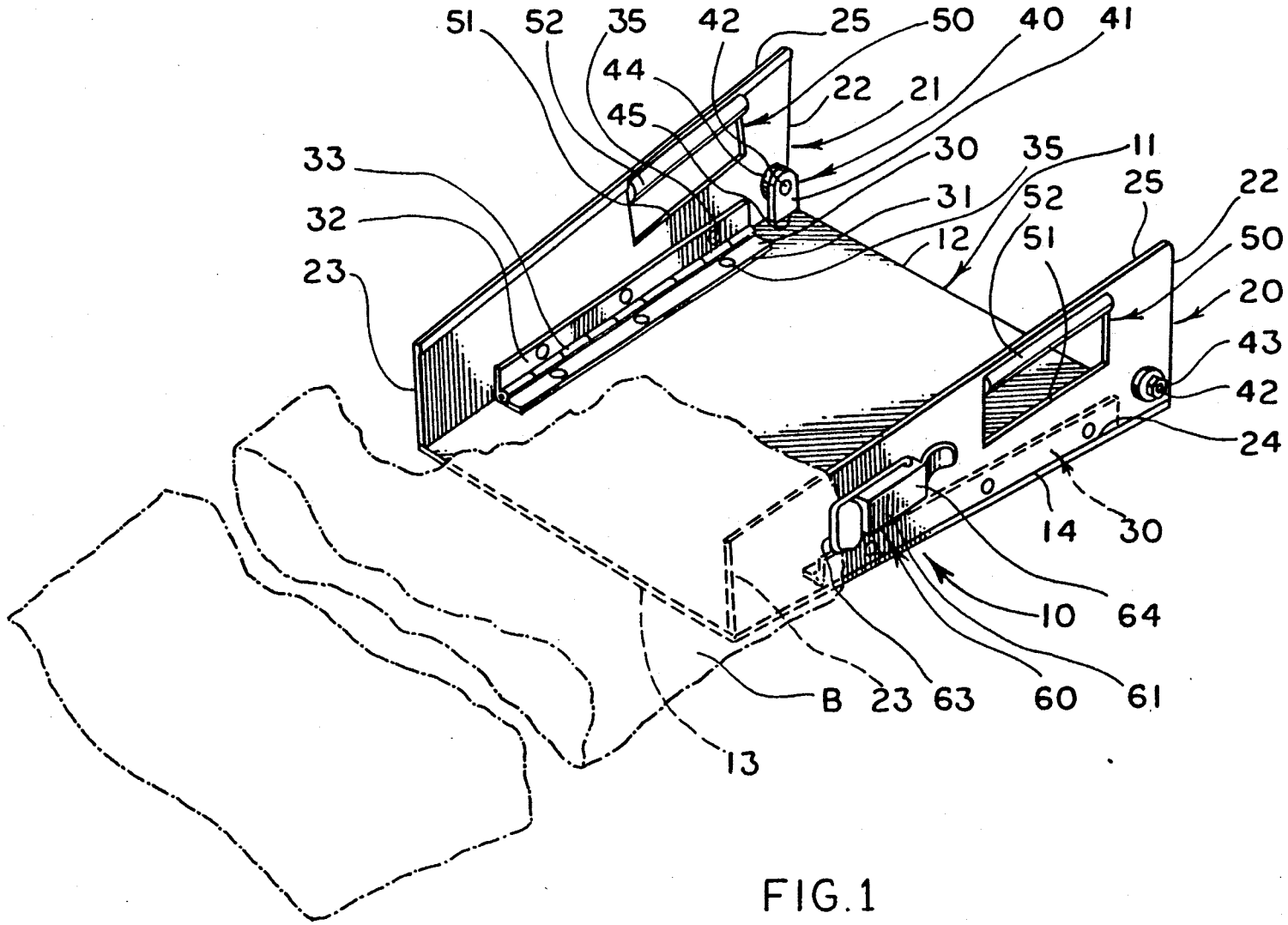
FIG. 1 is a top and side perspective view of an exemplary bag loader embodying the concepts of the present invention and showing the temporary interrelation with a fragmentary portion of a conventional sandbag shown in chain lines.
Figure 2:
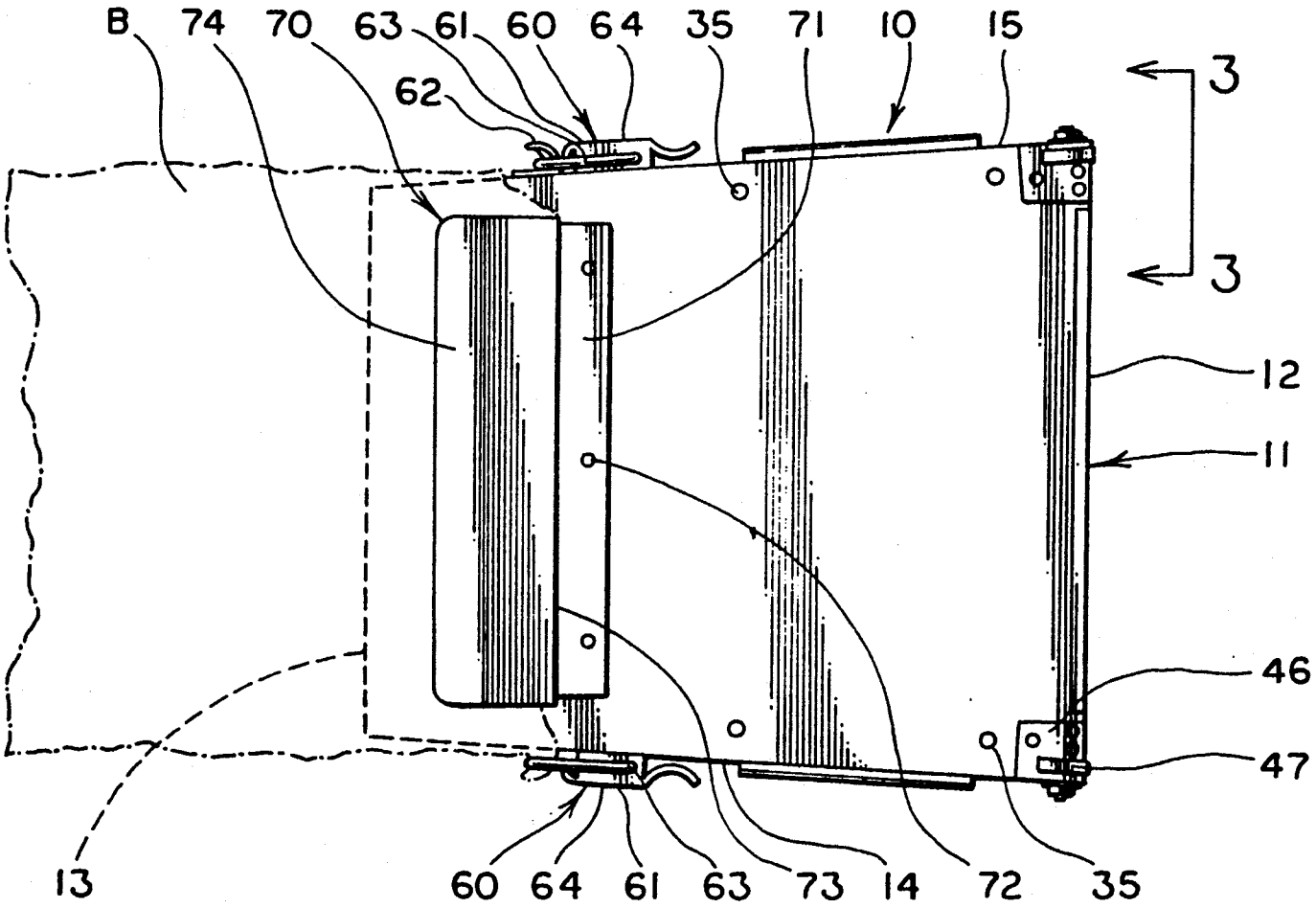
FIG. 2 is a bottom plan view of the bag loader of FIG. 1 showing additional details of the interrelation with a conventional sandbag and the locking latches for selectively maintaining the side plates in substantially perpendicular relation to the base.
Figure 3:
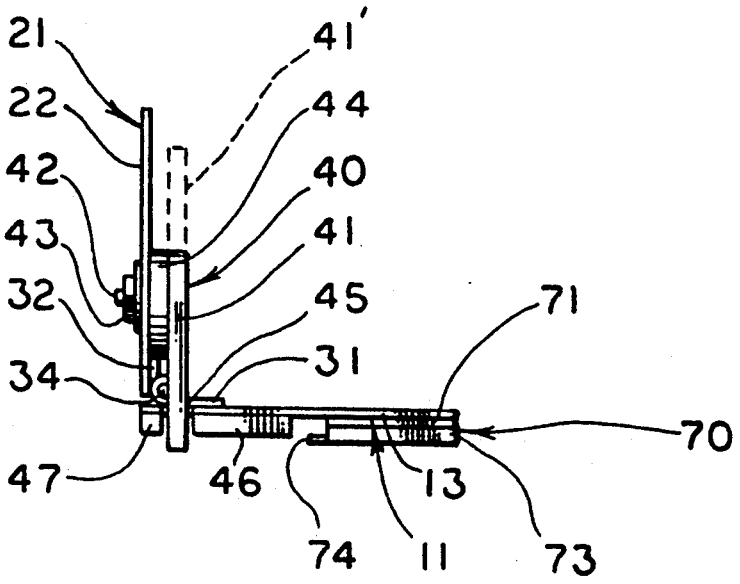
FIG. 3 is a fragmentary end elevational view taken substantially along the line 3—3 of FIG. 2 and showing details of the mounting and operation of the locking latches.

Loading apparatus according to the concepts of the present invention for collecting particulate matter and directing it into a bag, and particularly the first embodiment thereof depicted in FIGS. 1-3 of the drawings, is generally indicated by the numeral 10. The loading apparatus 10 is designed to be employed in conjunction with a sack, bag, or other preferably flexible container, such as the bag B, which is depicted for exemplary purposes in chain lines in FIGS. 1 and 2 of the drawings. The bag B serves as a repository for particulate matter such as sand, grain, or other materials which are gathered by the loading apparatus 10 and scooped or otherwise displaced or transferred into the bag B. The exemplary loading apparatus 10 shown herein is of a type which, as will appear, is readily portable by being lightweight and foldable and would be particularly adaptable for use by the military or other personnel in the filling of sand bags for military purposes or disaster control in the nature of flooding. It will, however, be appreciated that the loading apparatus 10 could be employed in a wide variety of other sacking or bagging applications, such as grain or the like.

The loading apparatus 10 has a base, generally indicated by the numeral 11, as a primary member for supporting particulate matter and for positioning bag B. As shown, the base 11 may be a substantially planar member having a generally trapezoidal configuration. In particular, the base 11 has a scoop end 12 and a bag end 13 which may be parallel thereto. The ends 12 and 13 are spaced and joined at their lateral extremities by lateral edges 14 and 15 (see FIG. 2). The distance between the edges 14 and 15 preferably tapers inwardly from the scoop end 12 longitudinally of base 11 to the bag end 13 for purposes which become apparent hereinafter.

Pivotally attached to the base 11 proximate the lateral edges 14 and 15 thereof are side plates, generally indicated by the numerals 20 and 21, respectively. The side plates 20, 21 may also be trapezoidal, with each having an end 22 positioned proximate the end 12 of base 11 and a parallel end 23 proximate the end 13 of base 11. The side plates 20, 21 may also each have bottom edges 24 and top edges 25 which join the ends 22, 23 and are preferably non-parallel and converging from the end 22 to the end 23, such that end 23 is of a lesser linear extent than end 22. The base 11 and side plates 20, 21 may be sized and tapered as hereinabove described in such a manner that a bag B overfits by virtue of its opening and snugly engages a portion of the outer surfaces of base 11 and side plates 20, 21.

The side plates 20, 21 are selectively pivotally attached to the base 11 by hinges, generally indicated by the numeral 30. The hinges 30 have a leaf 31 attached to the base 11 proximate an edge 24 and a leaf 32 attached to either side plates 20 or 21 proximate the bottom edge 24. Each of the leaves 31, 32 have alternately interfitting knuckles 33 of conventional configuration, which are joined by a hinge pin 34 (see FIG. 3). The leaves 31, 32 are fixed to the base 11 and to either of side plates 20, 21, respectively, as by suitable fasteners such as rivets 35.

It will thus be evident that the pivotally-mounted side plates 20, 21 may be selectively pivoted from the operating position depicted in FIG. 1 downwardly and inwardly, as viewed in FIG. 1, to overlie and substantially parallel the base 11 in the storage position. The side plates 20, 21 are maintained in the operating position substantially perpendicular to the base 11 by virtue of a pair of locking mechanisms, generally indicated by the numeral 40. The locking mechanisms 40, as best seen in FIGS. 1 and 3, have a pivotally-mounted latch 41 which is affixed to the respective side plates 20, 21 as by a fastener, such as a bolt 42 and a nut 43. Each of the latches 41 is spaced from the respective side plates 20, 21 as by a spacer 44.

Each latch 41 of the locking mechanisms 40 engages a slot 45 extending from the scoop end 12 to the base 11. If desired, the base 11 may be provided with a reinforcing block 46, as best seen in FIGS. 2 and 3, having a slot 47 comparable in terms of width and length to the slot 45. Thus, the slot 45, as reinforced by slot 47 and block 46, extends from end 12 of base 11 in a direction substantially paralleling the adjacent lateral edge 14 or 15 of the base 11. It will be appreciated that the latches 41 are positioned as depicted in FIG. 1 to effect a locking of the side plates 20, 21 in the operating position of FIG. 1. When it is desired to position the side plates 20, 21 in the storage position, the latches 41 are moved out of slots 45, 47, such as to the latch position 41' depicted in chain lines in FIG. 3 of the drawings, at which time side plates 20, 21 may be pivoted about the hinges 30.

The loading apparatus 10 has a gripping assembly, generally indicated by the numeral 50, on each of the side plates 20, 21. Each gripping assembly 50 has an elongate, substantially rectangular slot 51 extending longitudinally of the side plates 20, 21 a distance, which permits insertion of the fingers of an operator of the loading apparatus 10. The rectangular slots 51 are preferably placed proximate to but spaced a short distance from the top edges 25 on the side plates 20, 21, such as to permit the thumb and a portion of the hand of an operator to overlie the top edges 25 of the side plates 20,

21. A pad 52 constructed of a cylindrical body of foam or other elastomeric material may be positioned on the upper side of each rectangular slot 51 to facilitate gripping by an operator. While the gripping assemblies 50 may be positioned generally medially longitudinally of the side plates 20, 21 of the loading apparatus 10, it may be advantageous for balancing purposes to position the gripping assemblies 50 somewhat closer to the ends 22 of side plates 20, 21 to facilitate balancing the loading apparatus 10 when a bag B is positioned thereon, as depicted in FIG. 1, and contains a quantity of particulate matter being loaded. The positioning also facilitates operation of the loading apparatus 10 to effect scooping motions and tipping of loading apparatus 10 to effect gravity-transfer of particulate matter from the end 12 of base 11 to a position proximate end 13, where the particulate matter is transferred into the bag B.

For purposes of temporarily retaining the bag B in position on the loading apparatus 10 during the loading thereof, the side plates 20, 21 are provided outwardly thereof with retaining assemblies, generally indicated by the numeral 60. The retaining assemblies 60 may be conventional clamps 61 which are adapted to selectively engage and release a portion of the mouth of a bag B on the loading apparatus 10. As shown, the clamps 61 each include a clamp block 62, which is fixed on the side plates 20, 21 (see FIG, 2). A clamp wire 63 is moved into and out of close proximity to the clamp block 62 for temporarily securing a bag B. The clamp wire 63 is moved into and out of the clamping position proximate to the clamp block 62 by a pivot 64. It will thus be appreciated that a bag B may be brought into proximity with the retaining assembly 60 and the clamp 61 actuated by pivoting the pivot block 64 to displace the clamp wire 63 from the clamp block 62, positioning the bag B over the clamp block 62, and moving the pivot block 64 such that the clamp wire 63 secures the bag B against the clamp block 62 in the manner shown in FIG. 1 of the drawings. When a bag B has been filled with particulate matter, the pivot block 64 may be actuated to move the clamp wire 63 away from the clamp block 62 to release the bag B from temporary attachment to the loading apparatus 10.

The loading apparatus 10 may be provided with an aligning assembly 70 which may be attached to the lower side of the base 11. The aligning assembly 70 consists of a substantially flat plate 71 attached to the base 11 as by rivets 72. The plate 71 has an offset 73 which forms a projecting lip 74 that extends towards the bag B and is spaced a short distance from the base 11. The distance is preferably sufficient to permit the bag B to be inserted between the projecting lip 74 and the base 11 to position the bag B for engagement by the retaining assemblies 60. It is also to be noted that the aligning assembly 70 serves to prevent the bag B from being accidentally disconnected or separated from the retaining assemblies 60 when the loading apparatus 10 is being employed as a scoop to collect particulate matter and displace it into the bag B.

Figure 5:
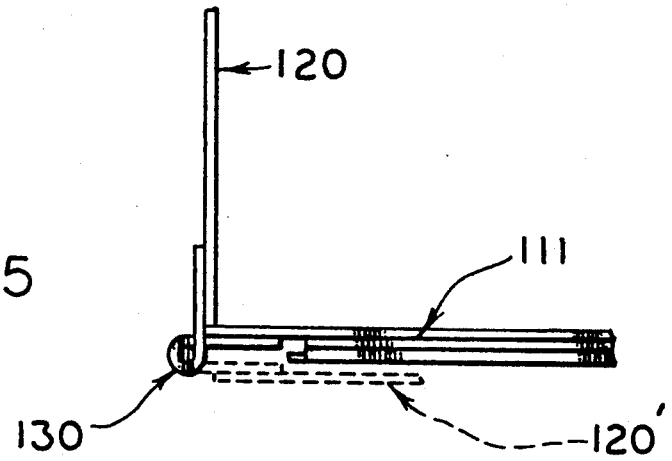
FIG. 5 is an enlarged fragmentary elevational view of the bag loader of FIG. 4 showing the operational and storage position of the side plates relative to the base.
Figure 4:
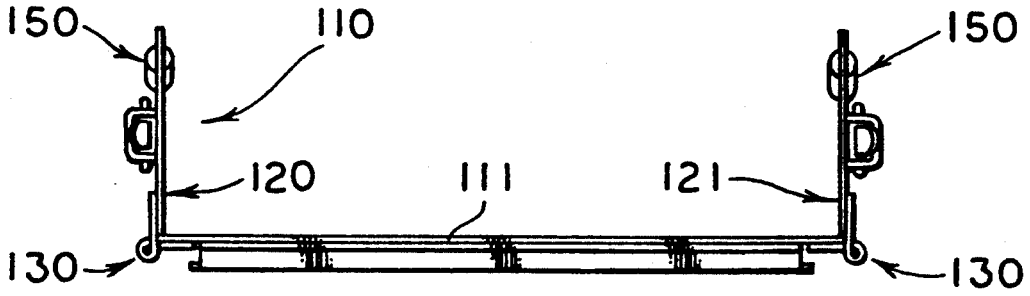
FIG. 4 is an end elevational view of an exemplary bag loader showing a second embodiment of the concepts of the present invention which employs a different hinge arrangement for positioning the side plates relative to the base.

A second embodiment of the loading apparatus according to the concepts of the present invention is generally indicated by the numeral 110 in FIG. 4 of the drawings. The loading apparatus 110 differs from the loading apparatus 10 solely in terms of the placement and operation of the hinges, generally indicated by the numeral 130. Rather than being positioned within the loading apparatus 110, the hinges 130 are positioned outwardly of the side plates 120 and 121 of the loading apparatus 110 and similarly outwardly of the base 111, which may be identical to the side plates 20, 21 and the base 11 of the loading apparatus 10. The loading apparatus 110 is shown in the operating position in FIGS. 4 and 5, with side plates 120, 121 pivoted by virtue of hinges 130 to a position substantially perpendicular to the base 111. The mounting of a bag B on the loading apparatus 110 and/or the engagement of the gripping assemblies 150 by an operator readily maintain the side plates 120, 121 in the operating position depicted in FIGS. 4 and 5 of the drawings without the necessity for locking mechanisms. When converting the loading apparatus 110 from the operating position to the storage position, the side plates 120, 121 are pivoted outwardly downwardly and around through approximately 270 degrees to the chain line position of the side plate 120', as seen in FIG. 5 of the drawings. It will thus be appreciated that the loading apparatus 110 can be made to store in a substantially flat, compact package.

As will be apparent to persons skilled in the art, the loading apparatus 10, 110 according to the present invention may be made of a wide variety of metallic sheet materials, of suitable plastics, or combinations thereof. In all instances, the selection of the type, thickness, and other characteristics of the materials which may be employed can readily be selected by persons skilled in the art based upon the particular application and sizing requirements of the loading apparatus for a particular intended purpose.

It is evident that the bag loading apparatus disclosed herein carries out the various objects of the invention set forth hereinabove and otherwise constitutes an advantageous contribution to the art. As will be apparent to persons skilled in the art, other modifications can be made to be the preferred embodiment disclosed herein without departing from the spirit of the invention, the scope of the invention being limited solely by the scope of the attached claims.

I claimed:

1. Loading apparatus for collecting particulate matter and directing it into a bag comprising, a generally planar base having a pair of spaced lateral edges and a pair of spaced ends joining the edges, a pair of side plates pivotally attached to said spaced lateral edges and movable between a storage position underlying and substantially parallel to said base and an operating position substantially perpendicular to said base by hinges attached outwardly of said side plates and said base for moving said side plates through approximately 270 degrees from said storage position to said operating position where said side plates and said base are in engagement, and means for temporarily positioning and retaining the bag when said side plates are in said operating position.

2. Loading apparatus according to claim 1, wherein said means for temporarily positioning and retaining the bag includes a pair of clamps, one of said clamps being attached laterally outwardly of each of said side plates when in the operating position.

3. Loading apparatus according to claim 1, wherein said base is generally trapezoidal and tapers downwardly toward the one of said ends where the bag is mounted.

4. Loading apparatus according to claim 1, wherein edges of said side plates proximate said hinges engage said planar base proximate said spaced lateral edges thereof when said side plates are in the operating position.

5. Loading apparatus according to claim 1, further comprising hand hole means in each of said pair of side plates.

6. Loading apparatus according to claim 5, wherein a pad is positioned on a portion of each of said hand hole means.

7. Loading apparatus according to claim 5, wherein said hand hole means are rectangular slots having the elongate dimension thereof extending longitudinally of said side plates.

8. Loading apparatus for collecting particulate matter and directing it into a bag comprising, a generally planar base having a pair of spaced lateral edges and a pair of spaced ends joining the edges, a pair of side plates pivotally attached by hinges to said spaced lateral edges and movable between a storage position substantially parallel to said base and an operating position substantially perpendicular to said base, means for temporarily positioning and retaining the bag when said side plates are in said operating position, and locking means for maintaining said side plates in said operating position, including a latch pivotally mounted on each of said side plates for movement into and out of engagement with said base and a slot in said base extending from one of said pair of spaced ends in a direction substantially paralleling one of said pair of lateral edges.

9. Loading apparatus according to claim 8, wherein said groove extends through and is surrounded by a reinforcing block attached to said base.

10. Loading apparatus for collecting particulate matter and directing it into a bag comprising, a generally planar base having a pair of spaced lateral edges and a pair of spaced ends joining the edges, a pair of side plates pivotally attached to said spaced lateral edges and movable between a storage position substantially parallel to said base and an operating position substantially perpendicular to said base, means for temporarily positioning and retaining the bag when said side plates are in said operating position, and aligning means on said base means for positioning the bag in alignment relative to said means for temporarily positioning and retaining the bag and in close proximity to said base.

11. Loading apparatus according to claim 10, wherein said aligning means is a projecting lip attached outwardly of said base.

12. Loading apparatus according to claim 11, wherein said projecting lip extends a substantial portion of the lateral extent of said base and a sufficient distance longitudinally thereof to overlie a portion of the bag when engaged by said means for temporarily positioning and retaining the bag.

* * * * *